US010242687B2

(12) United States Patent
Norvell et al.

(10) Patent No.: US 10,242,687 B2
(45) **Date of Patent: *Mar. 26, 2019**

(54) AUDIO SIGNAL DISCRIMINATOR AND CODER

(71) Applicant: Telefonaktiebolaget LM Ericsson (publ), Stockholm (SE)

(72) Inventors: Erik Norvell, Stockholm (SE); Volodya Grancharov, Solna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/451,551

(22) Filed: Mar. 7, 2017

(65) Prior Publication Data

US 2017/0178660 A1 Jun. 22, 2017

Related U.S. Application Data

(63) Continuation of application No. 14/649,689, filed as application No. PCT/SE2015/050503 on May 7, 2015, now Pat. No. 9,620,138.

(Continued)

(51) Int. Cl.
*G10L 19/22* (2013.01)
*G10L 19/16* (2013.01)

(Continued)

(52) U.S. Cl.
CPC ..... *G10L 19/22* (2013.01); *G10L 19/06* (2013.01); *G10L 19/167* (2013.01); *G10L 25/51* (2013.01);

(Continued)

(58) Field of Classification Search
CPC ..... G10L 19/22; G10L 19/06; G10L 19/167; G10L 25/18; G10L 19/20; G10L 25/51; G10L 25/81

(Continued)

(56) References Cited

U.S. PATENT DOCUMENTS 6,226,608 B1 * 5/2001 Fielder ..... G10L 19/022 345/545
2011/0047155 A1 * 2/2011 Sohn ..... G10L 19/022 707/736

(Continued)

FOREIGN PATENT DOCUMENTS

WO 2009000073 A1 12/2008
WO WO-2009000073 A1 * 12/2008 ..... G10L 25/78

OTHER PUBLICATIONS

Patent Cooperation Treaty, International Preliminary Examining Authority, PCT Notification and Transmittal of International Preliminary Report on Patentability and Response to Written Opinion Pursuant to Art. 34 PCT, International Patent Application Serial No. PCT/SE2015/050503, 16 pages (dated May 24, 2016).

*Primary Examiner* — Edwin S Leland, III
(74) *Attorney, Agent, or Firm* — Baker Botts, LLP

(57) ABSTRACT

The invention relates to a codec and a discriminator and methods therein for audio signal discrimination and coding. Embodiments of a method performed by an encoder comprises, for a segment of the audio signal: identifying a set of spectral peaks; determining a mean distance S between peaks in the set; and determining a ratio, PNR, between a peak envelope and a noise floor envelope. The method further comprises selecting a coding mode, out of a plurality of coding modes, based at least on the mean distance S and the ratio PNR; and applying the selected coding mode for coding of the segment of the audio signal.

15 Claims, 6 Drawing Sheets

Related U.S. Application Data

(60) Provisional application No. 61/990,354, filed on May 8, 2014.

(51) Int. Cl.

| | |
|---|---|
| ***G10L 19/06*** | (2013.01) |
| ***G10L 25/51*** | (2013.01) |
| *G10L 25/81* | (2013.01) |
| *G10L 19/20* | (2013.01) |
| *G10L 25/18* | (2013.01) |

(52) U.S. Cl.
CPC ..... *G10L 19/20* (2013.01); *G10L 25/18* (2013.01); *G10L 25/81* (2013.01)

(58) Field of Classification Search
USPC ..... 704/251
See application file for complete search history.

(56) References Cited

U.S. PATENT DOCUMENTS

2011/0270612 A1* 11/2011 Yoon ..... G09B 19/06 704/251
2012/0158401 A1* 6/2012 Mazurenko ..... G10L 25/81 704/208
2013/0282373 A1* 10/2013 Visser ..... G10L 21/0208 704/233
2016/0086615 A1* 3/2016 Norvell ..... G10L 25/51 704/501
2017/0178660 A1* 6/2017 Norvell ..... G10L 25/51

* cited by examiner $$issparse = S > S_{THR}$$
$$isclean = PNR > PNR_{THR}$$

AUDIO SIGNAL DISCRIMINATOR AND CODER

PRIORITY

This application is a continuation, under 35 U.S.C. § 120, of U.S. patent application Ser. No. 14/649,689, which is a U.S. National Stage Filing under 35 U.S.C. § 371 of International Patent Application Serial No. PCT/SE2015/050503, filed May 7, 2015, and entitled "Audio Signal Discriminator and Coder" which claims priority to U.S. Provisional Patent Application No. 61/990,354 filed May 8, 2014, both of which are hereby incorporated by reference in their entirety.

TECHNICAL FIELD

The proposed technology generally relates to codecs and methods for audio coding.

BACKGROUND

Modern audio codecs consists of multiple compression schemes optimized for signals with different properties. With practically no exception, speech-like signals are processed with time-domain codecs, while music signals are processed with transform-domain codecs. Coding schemes that are supposed to handle both speech and music signals require a mechanism to recognize whether the input signal comprises speech or music, and switch between the appropriate codec modes. Such a mechanism may be referred to as a speech-music classifier, or discriminator. An overview illustration of a multimode audio codec using mode decision logic based on the input signal is shown in FIG. 1*a*.

In a similar manner, among the class of music signals, one can discriminate more noise like music signals from harmonic music signals, and build a classifier and an optimal coding scheme for each of these groups. This abstraction of creating a classifier to determine the class of a signal, which then controls the mode decision is illustrated in FIG. 1*b*.

There are a variety of speech-music classifiers in the field of audio coding. However, these classifiers cannot discriminate between different classes in the space of music signals. In fact, many known classifiers do not provide enough resolution to be able to discriminate between classes of music in a way which is needed for application in a complex multimode codec.

SUMMARY

The problem of discriminating between e.g. harmonic and noise-like music segments is addressed herein, by use of a novel metric, calculated directly on the frequency-domain coefficients. The metric is based on the distribution of pre-selected spectral peaks candidates and the average peak-to-noise floor ratio.

The proposed solution allows harmonic and noise-like music segments to be identified, which in turn allows for optimal coding of these signal types. This coding concept provides a superior quality over the conventional coding schemes. The embodiments described herein deal with finding a better classifier for discrimination of harmonic and noise like music signals.

According to a first aspect, a method for encoding an audio signal is provided, which is to be performed by an audio signal encoder. The method comprises, for a segment of an audio signal, identifying a set of spectral peaks and determining a mean distance S between peaks in the set. The method further comprises determining a ratio, PNR, between a peak envelope and a noise floor envelope; selecting a coding mode, out of a plurality of coding modes, based at least on the mean distance S and the ratio PNR; and applying the selected coding mode.

According to a second aspect, an encoder is provided for encoding an audio signal. The encoder is configured to, for a segment of the audio signal, identify a set of spectral peaks and to determine a mean distance S between peaks in the set. The encoder is further configured to determine a ratio, PNR, between a peak envelope and a noise floor envelope; to select a coding mode, out of a plurality of coding modes, based on the mean distance S and the ratio PNR; and further ton apply the selected coding mode.

According to a third aspect, a method for signal discrimination is provided, which is to be performed by an audio signal discriminator. The method comprises, for a segment of an audio signal, identifying a set of spectral peaks and determining a mean distance S between peaks in the set. The method further comprises determining a ratio, PNR, between a peak envelope and a noise floor envelope. The method further comprises determining to which class of audio signals, out of a plurality of audio signal classes, that the segment belongs, based on at least the mean distance S and the ratio PNR.

According to a fourth aspect, an audio signal discriminator is provided. The discriminator is configured to, for a segment of an audio signal, identify a set of spectral peaks and determining a mean distance S between peaks in the set. The discriminator is further configured to determining a ratio, PNR, between a peak envelope and a noise floor envelope, and further to determine to which class of audio signals, out of a plurality of audio signal classes, that the segment belongs, based on at least the mean distance S and the ratio PNR.

According to a fifth aspect, a communication device is provided, comprising an encoder according to the second aspect.

According to a sixth aspect, a communication device is provided, comprising an audio signal discriminator according to the fourth aspect.

According to a seventh aspect, a computer program is provided, comprising instructions which, when executed on at least one processor, cause the at least one processor to carry out the method according to the first and/or the third aspect.

According to an eight aspect, a carrier is provided, containing the computer program of the previous claim, wherein the carrier is one of an electronic signal, optical signal, radio signal, or computer readable storage medium.

BRIEF DESCRIPTION OF DRAWINGS

The foregoing and other objects, features, and advantages of the technology disclosed herein will be apparent from the following more particular description of embodiments as illustrated in the accompanying drawings. The drawings are not necessarily to scale, emphasis instead being placed upon illustrating the principles of the technology disclosed herein.

DETAILED DESCRIPTION

Figure 1A:
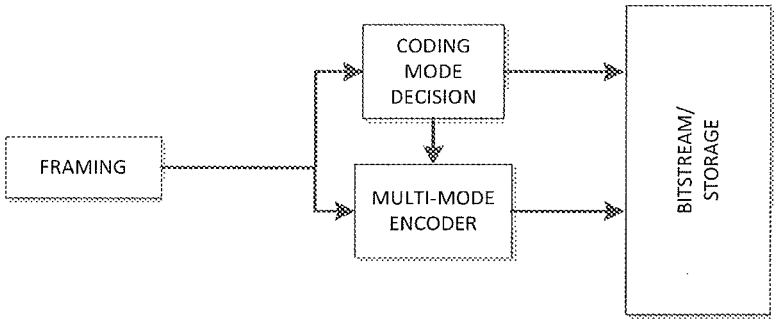
FIG. 1*a* is a schematic illustration of an audio codec where embodiments of the invention could be applied.
Figure 1B:
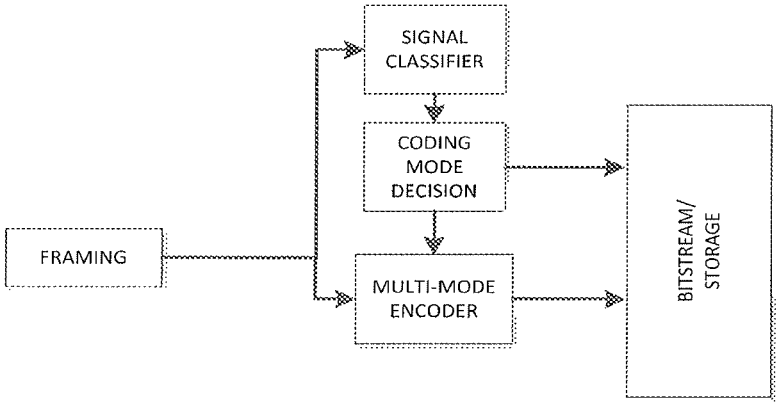
FIG. 1*b* is a schematic illustration of an audio codec explicitly showing a signal classifier.

The proposed technology may be applied to an encoder and/or decoder e.g. of a user terminal or user equipment, which may be a wired or wireless device. All the alternative devices and nodes described herein are summarized in the term "communication device", in which the solution described herein could be applied.

As used herein, the non-limiting terms "User Equipment" and "wireless device" may refer to a mobile phone, a cellular phone, a Personal Digital Assistant, PDA, equipped with radio communication capabilities, a smart phone, a laptop or Personal Computer, PC, equipped with an internal or external mobile broadband modem, a tablet PC with radio communication capabilities, a target device, a device to device UE, a machine type UE or UE capable of machine to machine communication, iPAD, customer premises equipment, CPE, laptop embedded equipment, LEE, laptop mounted equipment, LME, USB dongle, a portable electronic radio communication device, a sensor device equipped with radio communication capabilities or the like. In particular, the term "UE" and the term "wireless device" should be interpreted as non-limiting terms comprising any type of wireless device communicating with a radio network node in a cellular or mobile communication system or any device equipped with radio circuitry for wireless communication according to any relevant standard for communication within a cellular or mobile communication system.

As used herein, the term "wired device" may refer to any device configured or prepared for wired connection to a network. In particular, the wired device may be at least some of the above devices, with or without radio communication capability, when configured for wired connection.

The proposed technology may also be applied to an encoder and/or decoder of a radio network node. As used herein, the non-limiting term "radio network node" may refer to base stations, network control nodes such as network controllers, radio network controllers, base station controllers, and the like. In particular, the term "base station" may encompass different types of radio base stations including standardized base stations such as Node Bs, or evolved Node Bs, eNBs, and also macro/micro/pico radio base stations, home base stations, also known as femto base stations, relay nodes, repeaters, radio access points, base transceiver stations, BTSs, and even radio control nodes controlling one or more Remote Radio Units, RRUs, or the like.

The embodiments of the solution described herein are suitable for use with an audio codec. Therefore, the embodiments will be described in the context of an exemplifying audio codec, which operates on short blocks, e.g. 20 ms, of the input waveform. It should be noted that the solution described herein also may be used with other audio codecs operating on other block sizes. Further, the presented embodiments show exemplifying numerical values, which are preferred for the embodiment at hand. It should be understood that these numerical values are given only as examples and may be adapted to the audio codec at hand.

Exemplifying Embodiments

Figure 2:
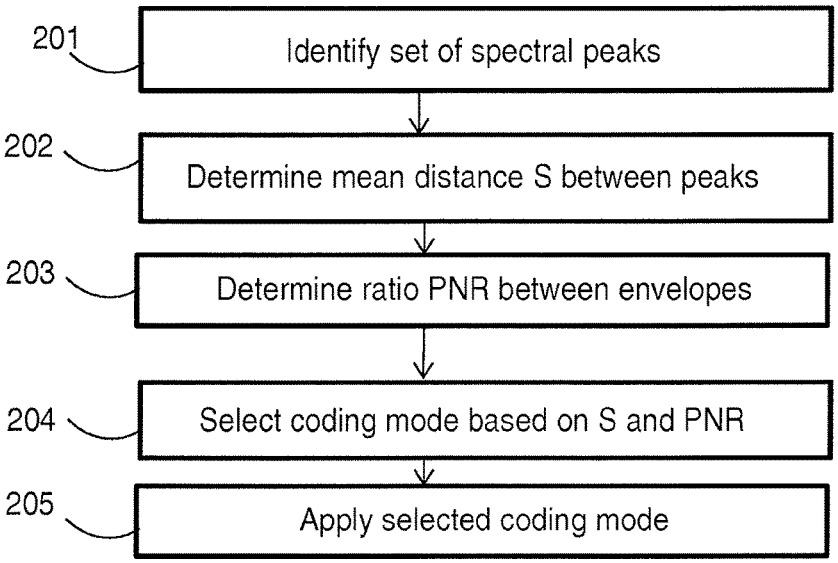
FIG. 2 is a flow chart illustrating a method according to an exemplifying embodiment.

Below, exemplifying embodiments related to a method for encoding an audio signal will be described with reference to FIG. 2. The method is to be performed by an encoder. The encoder may be configured for being compliant with one or more standards for audio coding. The method comprises, for a segment of the audio signal: identifying 201 a set of spectral peaks; determining 202 a mean distance S between peaks in the set; and determining 203 a ratio, PNR, between a peak envelope and a noise floor envelope. The method further comprises selecting 204 a coding mode, out of a plurality of coding modes, based on at least the mean distance S and the ratio PNR; and applying 205 the selected coding mode.

The spectral peaks may be identified in different ways, which also will be described in more detail below. For example, spectral coefficients of which the magnitude exceeds a defined threshold could be identified as belonging to a peak. When determining the mean distance S between peaks, each peak may be represented by a single spectral coefficient. This single coefficient would preferably be the spectral coefficient having the maximum squared amplitude of the spectral coefficients (if more than one) being associated with the peak. That is, when more than one spectral coefficient is identified as being associated with one spectral peak, one of the plurality of coefficients associated with the peak may then be selected to represent the peak when determining the mean distance S. This could be seen in FIG. 3*b*, and will be further described below. The mean distance S may also be referred to e.g. as the "peak sparsity".

Figure 3A:
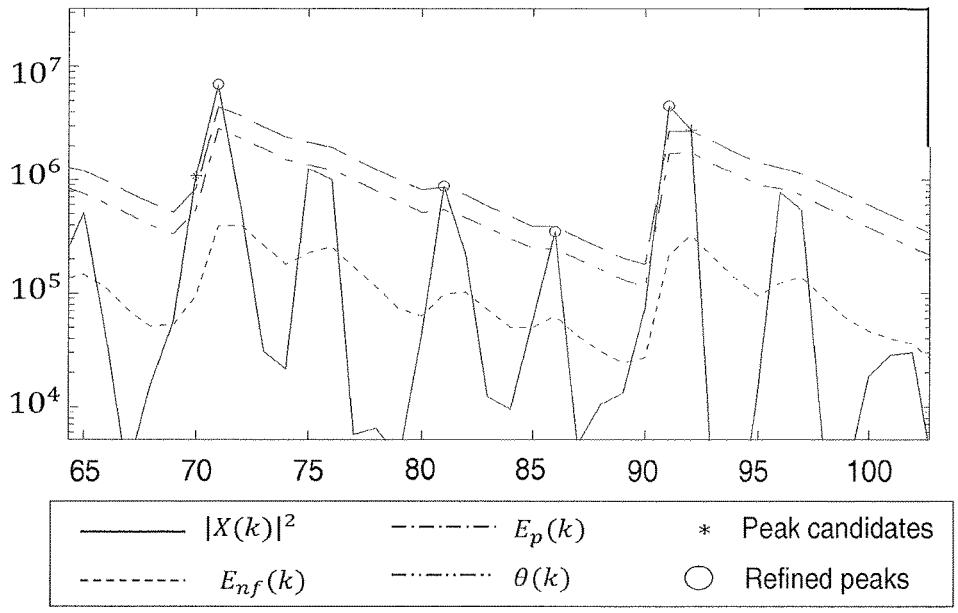
FIG. 3*a* is a diagram illustrating a peak selection algorithm and instantaneous peak and noise floor values according to an exemplifying embodiment.
Figure 3B:
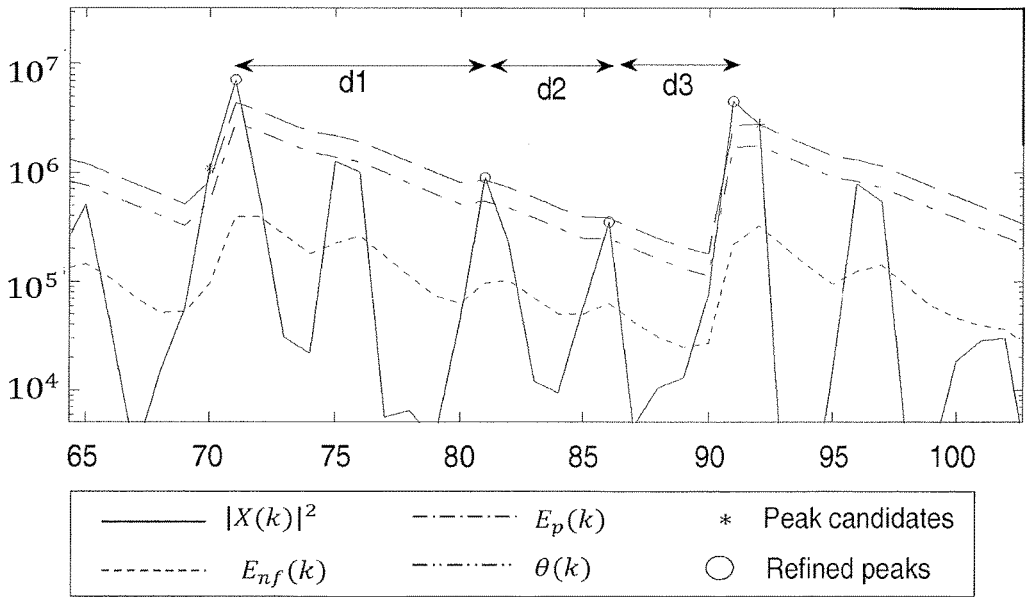
FIG. 3*b* is a diagram illustrating peak distances $d_i$, according to an exemplifying embodiment.

In order to determine a ratio between a peak envelope and a noise floor envelope, these envelopes need to be estimated. The noise floor envelope may be estimated based on absolute values of spectral coefficients and a weighting factor emphasizing the contribution of low-energy coefficients. Correspondingly, the peak envelope may be estimated based on absolute values of spectral coefficients and a weighting factor emphasizing the contribution of high-energy coefficients. FIGS. 3*a* and 3*b* show examples of estimated noise floor envelopes (short dashes) and peak envelopes (long dashes). By "low-energy" and "high-energy" coefficients should be understood coefficients having an amplitude with a certain relation to a threshold, where low-energy coefficients would typically be coefficients having an amplitude below (or possibly equal to) a certain threshold, and high-energy coefficients would typically be coefficients having an amplitude above (or possibly equal to) a certain threshold.

According to an exemplifying embodiment, the input waveform, i.e. the audio signal, is pre-emphasized e.g. with a first-order high-pass filter $H(z)=1-0.68\ z^{-1}$ before performing spectral analysis. This may e.g. be done in order to increase the modeling accuracy for the high frequency region, but it should be noted that it is not essential for the invention at hand.

A discrete Fourier transform (DFT) may be used to convert the filtered audio signal into the transform or frequency domain. In a specific example, the spectral analysis is performed once per frame using a 256-point fast Fourier transform (FFT).

An FFT is performed on the pre-emphasized, windowed input signal, i.e. on a segment of the audio signal, to obtain one set of spectral parameters as:

$$X(k) = \sum_{n=0}^{255} x(n) e^{-j2\pi \frac{kn}{256}}$$

where k=0, . . . , 255, is an index of frequency coefficients or spectral coefficients, and n is an index of waveform samples. It should be noted that any length N of the transform may be used. The coefficients could also be referred to as transform coefficients.

An object of the solution described herein is to achieve a classifier or discriminator, which not only may discriminate between speech and music, but also discriminate between different types of music. Below, it will be described in more detail how this object may be achieved according to an exemplifying embodiment of a discriminator:

The exemplifying discriminator requires knowledge of the location, e.g. in frequency, of spectral peaks of a segment of the input audio signal. Spectral peaks are here defined as coefficients with an absolute value above an adaptive threshold, which e.g. is based on the ratio of peak and noise-floor envelopes.

A noise-floor estimation algorithm that operates on the absolute values of transform coefficients |X(k)| may be used. Instantaneous noise-floor energies $E_{nf}(k)$ may be estimated according to the recursion:

$$E_{nf}(k) = \alpha E_{nf}(k-1) + (1-\alpha)|X(k)|^2$$

$$\alpha = \begin{cases} 0.9578 & \text{if} \quad |X(k)|^2 > E_{nf}(k-1) \\ 0.6472 & \text{if} \quad |X(k)|^2 \le E_{nf}(k-1) \end{cases}$$

The particular form of the weighting factor α minimizes the effect of high-energy transform coefficients and emphasizes the contribution of low-energy coefficients. Finally the noise-floor level $\overline{E}_{nf}$ is estimated by simply averaging the instantaneous energies $E_{nf}$.

$$\overline{E}_{nf} = (\Sigma_{k=0}^{255} E_{nf}(k))/256$$

One embodiment of the "peak-picking" algorithm presented herein requires knowledge of a noise-floor energy level and average energy level of spectral peaks. The peak energy estimation algorithm used herein is similar to the noise-floor estimation algorithm above, but instead of low-energy, it tracks high-spectral energies as:

$$E_p(k) = \beta E_p(k-1) + (1-\beta)|X(k)|^2$$

$$\beta = \begin{cases} 0.4223 & \text{if} \quad |X(k)|^2 > E_p(k-1) \\ 0.8029 & \text{if} \quad |X(k)|^2 \le E_p(k-1) \end{cases}$$

In this case, the weighting factor β minimizes the effect of low-energy transform coefficients and emphasizes the contribution of high-energy coefficients. The overall peak energy $\overline{E}_p$ is here estimated by averaging the instantaneous energies as:

$$\overline{E}_p = (\Sigma_{k=0}^{255} E_p(k))/256$$

When the peak and noise-floor levels are calculated, a threshold level τ may be formed as:

$$\tau = \left(\frac{\overline{E}_p}{\overline{E}_{nf}}\right)^{\gamma} \overline{E}_{nf}$$

with γ set to the exemplifying value γ=0.88579. Transform coefficients of a segment of the input audio signal are then compared to the threshold, and the ones with an amplitude exceeding the threshold form a vector of peak candidates. That is, a vector comprising the coefficients which are assumed to belong to spectral peaks.

An alternative threshold value, θ(k), which may require less computational complexity to calculate than τ, could be used for detecting peaks. In one embodiment, θ(k) is found as the instantaneous peak envelope level, $E_p(k)$, with a fixed scaling factor. Here, the scaling factor 0.64 is used as an example, such that:

$$\theta(k) = E_p(k) \cdot 0.64$$

When using the alternative threshold, θ, the peak candidates are defined to be all the coefficients with a squared amplitude above the instantaneous threshold level, as:

$$\begin{cases} |X(k)|^2 > \theta(k), k \in P \\ |X(k)|^2 \le \theta(k), k \notin P \end{cases}$$

where P denotes the frequency ordered set of positions of peak candidates. Considering the FFT spectrum, some peaks will be broad and consist of several transform coefficients, while others are narrow and are represented by a single coefficient. In order to get a peak representation of individual coefficients, i.e. one coefficient per peak, peak candidate coefficients in consecutive positions are assumed to be part of a broader peak. By finding the maximum squared amplitude $|X(k)|^2$ of the transform coefficients in a range of consecutive peak candidate positions . . . k−1, k, k+1, . . . , a refined set Ṕ is created, where the broad peaks are represented by the maximum position in each range, i.e. by the coefficient having the highest value of $|X(k)|^2$ in the range, which could also be denoted the coefficient having the largest spectral magnitude in the range. FIG. 3*a* illustrates the derivation of the peak envelope and noise floor envelope, and the peak selection algorithm.

The above calculations serve to generate two features that are used for forming a classifier decision: namely an estimate of the peak sparsity S and a peak-to-noise floor ratio PNR. The peak sparsity S may be represented or defined using the average distance $d_i$ between peaks as:

$$S = \begin{cases} \frac{1}{N_d} \sum_{i=1}^{N} d_i, N_d > 1 \\ 0, N_d \le 1 \end{cases}$$

where $N_d$ is the number of refined peaks in the set Ṕ. The PNR may be calculated as $$PNR = \frac{\overline{E}_p}{\overline{E}_{nf}}$$

The classifier decision may be formed using these features in combination with a decision threshold. We can name these decisions "issparse" and "isclean", as:

$$\text{issparse}=S>S_{THR}$$

$$\text{isclean}=PNR>PNR_{THR}$$

Figure 4:
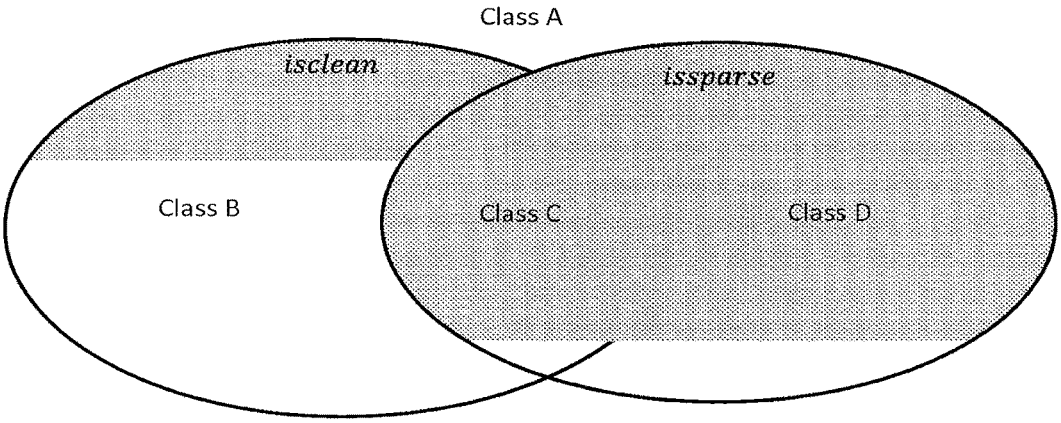
FIG. 4 illustrates a Venn diagram of decisions according to an exemplifying embodiment.

The outcome of these decisions may be used to form different classes of signals. An illustration of these classes is shown in FIG. 4. When the classification is based on two binary decisions, the total number of classes may be at most 4. As a next step, the codec decision can be formed using the class information, which is illustrated in Table 1.

TABLE 1

Possible classes formed using two feature decisions.

| | isclean | Issparse |
|---|---|---|
| Class A | false | false |
| Class B | true | false |
| Class C | true | true |
| Class D | false | true |

In the following step in the audio codec, a decision is to be made which processing steps to apply to which class. That is, a coding mode is to be selected based at least on S and PNR. This selection or mapping will depend on the characteristics and capabilities of the different coding modes or processing steps available. As an example, perhaps Codec mode 1 would handle Class A and Class C, while Codec mode 2 would handle Class B and Class D. The coding mode decision can be the final output of the classifier to guide the encoding process. The coding mode decision would typically be transferred in the bitstream together with the codec parameters from the chosen coding mode.

It should be understood that the above classes may be further combined with other classifier decisions. The combination may result in a larger number of classes, or they may be combined using a priority order such that the presented classifier may be overruled by another classifier, or vice versa that the presented classifier may overrule another classifier.

The solution described herein provides a high-resolution music type discriminator, which could, with advantage, be applied in audio coding. The decision logic of the discriminator is based on statistics of positional distribution of frequency coefficients with prominent energy.

Implementations

The method and techniques described above may be implemented in encoders and/or decoders, which may be part of e.g. communication devices.

Figure 5D:
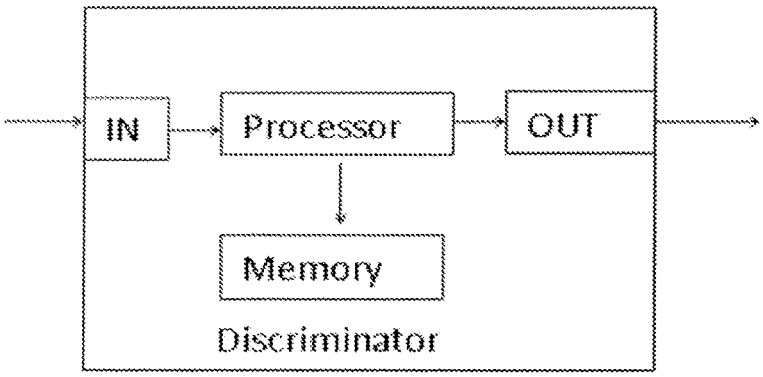
FIG. 5*d* illustrates an implementation of a discriminator according to an exemplifying embodiment.
Figure 5A:
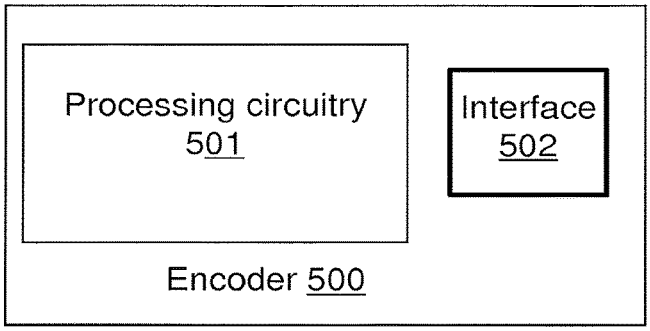
FIGS. 5*a-c* illustrate implementations of an encoder according to exemplifying embodiments.
Figure 5B:
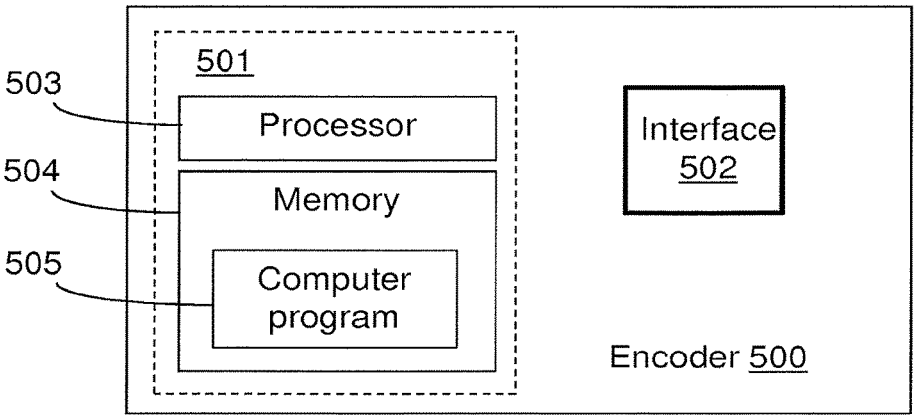
Figure 5C:
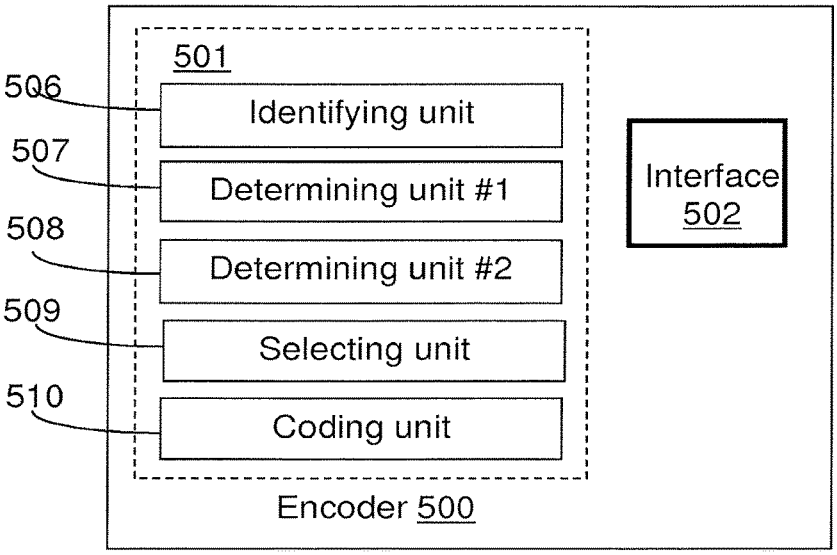

Encoder, FIGS. 5*a*-5*c*

An exemplifying embodiment of an encoder is illustrated in a general manner in FIG. 5*a*. By encoder is referred to an encoder configured for coding of audio signals. The encoder could possibly further be configured for encoding other types of signals. The encoder 500 is configured to perform at least one of the method embodiments described above e.g. with reference to FIG. 2. The encoder 500 is associated with the same technical features, objects and advantages as the previously described method embodiments. The encoder may be configured for being compliant with one or more standards for audio coding. The encoder will be described in brief in order to avoid unnecessary repetition.

The encoder may be implemented and/or described as follows:

The encoder 500 is configured for encoding of an audio signal. The encoder 500 comprises processing circuitry, or processing means 501 and a communication interface 502. The processing circuitry 501 is configured to cause the encoder 500 to, for a segment of the audio signal: identify a set of spectral peaks; determine a mean distance S between peaks in the set; and to determine a ratio, PNR, between a peak envelope and a noise floor envelope. The processing circuitry 501 is further configured to cause the encoder to select a coding mode, out of a plurality of coding modes, based at least on the mean distance S and the ratio PNR; and to apply the selected coding mode. The communication interface 502, which may also be denoted e.g. Input/Output (I/O) interface, includes an interface for sending data to and receiving data from other entities or modules.

The processing circuitry 501 could, as illustrated in FIG. 5*b*, comprise processing means, such as a processor 503, e.g. a CPU, and a memory 504 for storing or holding instructions. The memory would then comprise instructions, e.g. in form of a computer program 505, which when executed by the processing means 503 causes the encoder 500 to perform the actions described above.

An alternative implementation of the processing circuitry 501 is shown in FIG. 5*c*. The processing circuitry here comprises an identifying unit 506, configured to identify a set of spectral peaks, for/of a segment of the audio signal. The processing circuitry further comprises a first determining unit 507, configured to cause the encoder 500 to determine determine a mean distance S between peaks in the set. The processing circuitry further comprises a second determining unit 508 configured to cause the encoder to determine a ratio, PNR, between a peak envelope and a noise floor envelope. The processing circuitry further comprises a selecting unit 509, configured to cause the encoder to select a coding mode, out of a plurality of coding modes, based at least on the mean distance S and the ratio PNR. The processing circuitry further comprises a coding unit 510, configured to cause the encoder to apply the selected coding mode. The processing circuitry 501 could comprise more units, such as a filter unit configured to cause the encoder to filter the input signal. This task, when performed, could alternatively be performed by one or more of the other units.

The encoders, or codecs, described above could be configured for the different method embodiments described herein, such as using different thresholds for detecting peaks. The encoder 500 may be assumed to comprise further functionality, for carrying out regular encoder functions.

Examples of processing circuitry includes, but is not limited to, one or more microprocessors, one or more Digital Signal Processors, DSPs, one or more Central Processing Units, CPUs, video acceleration hardware, and/or any suitable programmable logic circuitry such as one or more Field Programmable Gate Arrays, FPGAs, or one or more Programmable Logic Controllers, PLCs.

It should also be understood that it may be possible to re-use the general processing capabilities of any conventional device or unit in which the proposed technology is implemented. It may also be possible to re-use existing software, e.g. by reprogramming of the existing software or by adding new software components.

Discriminator, FIG. 5*d*

FIG. 5*d* shows an exemplifying implementation of a discriminator, or classifier, which could be applied in an encoder or decoder. As illustrated in FIG. 5*d*, the discriminator described herein could be implemented e.g. by one or more of a processor and adequate software with suitable storage or memory therefore, in order to perform the discriminatory action of an input signal, according to the embodiments described herein. In the embodiment illustrated in FIG. 5*d*, an incoming signal is received by an input (IN), to which the processor and the memory are connected, and the discriminatory representation of an audio signal (parameters) obtained from the software is outputted at the output (OUT).

The discriminator could discriminate between different audio signal types by, for a segment of an audio signal, identify a set of spectral peaks and determine a mean distance S between peaks in the set. Further, the discriminator could determine a ratio, PNR, between a peak envelope and a noise floor envelope, and then determine to which class of audio signals, out of a plurality of audio signal classes, that the segment belongs, based on at least the mean distance S and the ratio PNR. By performing this method, the discriminator enables e.g. an adequate selection of an encoding method or other signal processing related method for the audio signal.

The technology described above may be used e.g. in a sender, which can be used in a mobile device (e.g. mobile phone, laptop) or a stationary device, such as a personal computer, as previously mentioned.

Figure 6:
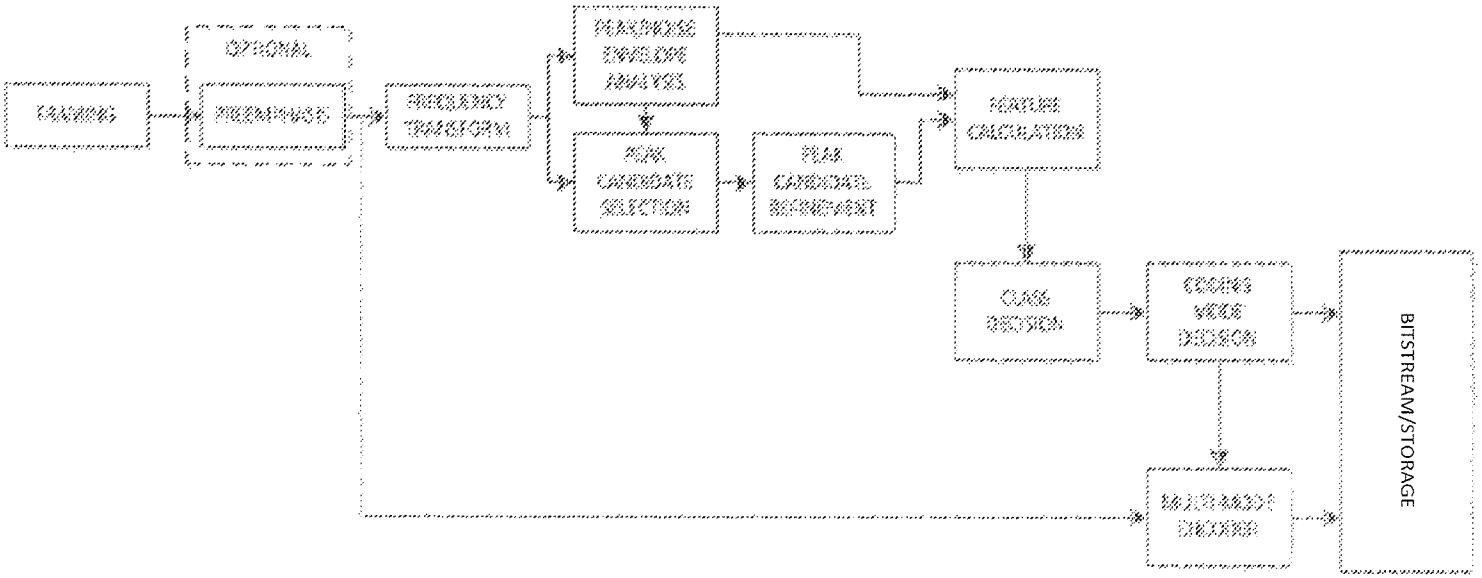
FIG. 6 illustrates an embodiment of an encoder.

An overview of an exemplifying audio signal discriminator can be seen in FIG. 6. FIG. 6 shows a schematic block diagram of an encoder with a discriminator according to an exemplifying embodiment. The discriminator comprises an input unit configured to receive an input signal representing an audio signal to be handled, a Framing unit, an optional Pre-emphasis unit, a Frequency transforming unit, a Peak/Noise envelope analysis unit, a Peak candidate selection unit, a Peak candidate refinement unit, a Feature calculation unit, a Class decision unit, a Coding mode decision unit, a Multi-mode encoder unit, a Bit-streaming/Storage and an output unit for the audio signal. All these units could be implemented in hardware. There are numerous variants of circuitry elements that can be used and combined to achieve the functions of the units of the encoder. Such variants are encompassed by the embodiments. Particular examples of hardware implementation of the discriminator are implementation in digital signal processor (DSP) hardware and integrated circuit technology, including both general-purpose electronic circuitry and application-specific circuitry.

A discriminator according to an embodiment described herein could be a part of an encoder, as previously described, and an encoder according to an embodiment described herein could be a part of a device or a node. As previously mentioned, the technology described herein may be used e.g. in a sender, which can be used in a mobile device, such as e.g. a mobile phone or a laptop; or in a stationary device, such as a personal computer.

It is to be understood that the choice of interacting units or modules, as well as the naming of the units are only for exemplary purpose, and may be configured in a plurality of alternative ways in order to be able to execute the disclosed process actions.

It should also be noted that the units or modules described in this disclosure are to be regarded as logical entities and not with necessity as separate physical entities. It will be appreciated that the scope of the technology disclosed herein fully encompasses other embodiments which may become obvious to those skilled in the art, and that the scope of this disclosure is accordingly not to be limited.

Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed hereby. Moreover, it is not necessary for a device or method to address each and every problem sought to be solved by the technology disclosed herein, for it to be encompassed hereby.

In the preceding description, for purposes of explanation and not limitation, specific details are set forth such as particular architectures, interfaces, techniques, etc. in order to provide a thorough understanding of the disclosed technology. However, it will be apparent to those skilled in the art that the disclosed technology may be practiced in other embodiments and/or combinations of embodiments that depart from these specific details. That is, those skilled in the art will be able to devise various arrangements which, although not explicitly described or shown herein, embody the principles of the disclosed technology. In some instances, detailed descriptions of well-known devices, circuits, and methods are omitted so as not to obscure the description of the disclosed technology with unnecessary detail. All statements herein reciting principles, aspects, and embodiments of the disclosed technology, as well as specific examples thereof, are intended to encompass both structural and functional equivalents thereof. Additionally, it is intended that such equivalents include both currently known equivalents as well as equivalents developed in the future, e.g. any elements developed that perform the same function, regardless of structure.

Thus, for example, it will be appreciated by those skilled in the art that the figures herein can represent conceptual views of illustrative circuitry or other functional units embodying the principles of the technology, and/or various processes which may be substantially represented in computer readable medium and executed by a computer or processor, even though such computer or processor may not be explicitly shown in the figures.

The functions of the various elements including functional blocks may be provided through the use of hardware such as circuit hardware and/or hardware capable of executing software in the form of coded instructions stored on computer readable medium. Thus, such functions and illustrated functional blocks are to be understood as being either hardware-implemented and/or computer-implemented, and thus machine-implemented.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible.

ABBREVIATIONS

DFT Discrete Fourier Transform
FFT Fast Fourier Transform
MDCT Modified Discrete Cosine Transform
PNR Peak to Noise floor ratio

The invention claimed is:

1. A method for encoding an audio signal, the method comprising:

converting, by a processor, an audio signal with a discrete Fourier transform (DFT) to a frequency domain;

identifying a set of spectral peaks for a segment of the audio signal;

determining a mean distance S between peaks in the set;

determining a ratio, PNR, between a peak envelope energy and a noise floor energy;

comparing the mean distance S to a peak sparcity threshold;

comparing the ratio PNR to a ratio PNR threshold;

based on comparing the mean distance S to the peak sparcity threshold and comparing the ratio PNR to the ratio PNR threshold, classifying the audio signal into one of a plurality of classes;

selecting a coding mode, out of a plurality of coding modes, based on at least the classification of the audio signal into the one of the plurality of classes;

encoding the audio signal based on the selected coding mode; and transmitting the audio signal encoded based on the selected coding mode.

2. The method according to claim 1, wherein, when determining S, each peak is represented by a spectral coefficient, being the spectral coefficient having the maximum squared amplitude of the spectral coefficients associated with the peak.

3. The method according to claim 1, wherein the noise floor energy is estimated based on absolute values of spectral coefficients and a weighting factor emphasizing the contribution of low-energy coefficients as compared to high energy coefficients.

4. The method according to claim 1, wherein the peak envelope energy is estimated based on absolute values of spectral coefficients and a weighting factor emphasizing the contribution of high-energy coefficients as compared to low energy coefficients.

5. The method according to claim 1, wherein spectral peaks are detected in relation to an instantaneous peak envelope level multiplied by a fixed scaling factor.

6. An encoder for encoding an audio signal, the encoder comprising:

a memory storing instructions; and a processor operable to execute the instructions to cause the encoder to:

convert an audio signal with a discrete Fourier transform (DFT) to a frequency domain;

identify a set of spectral peaks for a segment of the audio signal;

determine a mean distance S between peaks in the set;

determine a ratio, PNR, between a peak envelope energy and a noise floor energy;

comparing the mean distance S to a peak sparcity threshold;

comparing the ratio PNR to a ratio PNR threshold;

based on comparing the mean distance S to the peak sparcity threshold and comparing the ratio PNR to the ratio PNR threshold, classifying the audio signal into one of a plurality of classes;

select a coding mode, out of a plurality of coding modes, based on at least the classification of the audio signal into the one of the plurality of classes;

encode the audio signal based on the selected coding mode; and transmit the audio signal encoded based on the selected coding mode.

7. The encoder according to claim 6, wherein, when determining the mean distance S, each peak is represented by a spectral coefficient, being the spectral coefficient having the maximum squared amplitude of the spectral coefficients associated with the peak.

8. The encoder according to claim 6, wherein the processor is operable to execute the instructions to cause the encoder to estimate the noise floor energy based on absolute values of spectral coefficients and a weighting factor emphasizing the contribution of low-energy coefficients as compared to high energy coefficients.

9. The encoder according to claim 6, wherein the processor is operable to execute the instructions to cause the encoder to estimate the peak envelope energy based on absolute values of spectral coefficients and a weighting factor emphasizing the contribution of high-energy coefficients as compared to low energy coefficients.

10. The encoder according to claim 6, wherein the processor is operable to execute the instructions to cause the encoder to detect spectral peaks in relation to an instantaneous peak envelope level multiplied by a fixed scaling factor.

11. Communication device comprising an encoder according to claim 6.

12. A method for audio signal discrimination, the method comprising:

converting an audio signal with a discrete Fourier transform (DFT) to a frequency domain;

identifying a set of spectral peaks for a segment of the audio signal;

determining a mean distance S between peaks in the set;

determining a ratio, PNR, between a peak envelope energy and a noise floor energy;

comparing the mean distance S to a peak sparcity threshold;

comparing the ratio PNR to a ratio PNR threshold;

determining to which class of audio signals, out of a plurality of audio signal classes, the audio segment belongs, based on at least the comparison of the mean distance S to the peak sparcity threshold and the ratio PNR to the ratio PNR threshold;

encoding the audio signal based on the selected coding mode; and transmitting the audio signal encoded based on the selected coding mode.

13. An audio signal discriminator, comprising:

a memory storing instructions; and a processor operable to execute the instructions to cause the audio signal discriminator to:

convert an audio signal with a discrete Fourier transform (DFT) to a frequency domain;

identify a set of spectral peaks for a segment of the audio signal;

determine a mean distance S between peaks in the set;

determine a ratio, PNR, between a peak envelope energy and a noise floor energy;

compare the mean distance S to a peak sparcity threshold;

compare the ratio PNR to a ratio PNR threshold;

determine to which class of audio signals, out of a plurality of audio signal classes, the audio segment belongs, based on at least the comparison of the mean distance S to the peak sparcity threshold and the ratio PNR to the ratio PNR threshold;

encode the audio signal based on the selected coding mode; and transmit the audio signal encoded based on the selected coding mode.

14. Communication device comprising a signal discriminator according to claim 13.

15. A non-transitory computer-readable storage medium storing instructions which, when executed on at least one processor, cause the at least one processor to:

convert an audio signal with a discrete Fourier transform (DFT) to a frequency domain;

identify a set of spectral peaks for a segment of the audio signal;

determine a mean distance S between peaks in the set;

determine a ratio, PNR, between a peak envelope energy and a noise floor energy;

compare the mean distance S to a peak sparcity threshold;

compare the ratio PNR to a ratio PNR threshold;

based on comparing the mean distance S to the peak sparcity threshold and comparing the ratio PNR to the ratio PNR threshold, classifying the audio signal into one of a plurality of classes;

select a coding mode, out of a plurality of coding modes, based on at least the classification of the audio signal into the one of the plurality of classes;

encode the audio signal based on the selected coding mode; and transmit the audio signal encoded based on the selected coding mode.

* * * * *